US009856693B2

(12) United States Patent
Herth et al.

(10) Patent No.: US 9,856,693 B2
(45) Date of Patent: Jan. 2, 2018

(54) CORNER FITTING WITH VARIABLY ADJUSTABLE RESTRAINING AREA

(71) Applicant: DORMA Deutschland GmbH, Ennepetal (DE)

(72) Inventors: Holger Herth, Ennepetal (DE); Jorg Sunderbrink, Ennepetal (DE); Kenan Aykas, Enneptal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/956,271

(22) Filed: Dec. 1, 2015

(65) Prior Publication Data

US 2016/0160556 A1 Jun. 9, 2016

(30) Foreign Application Priority Data

Dec. 4, 2014 (EP) ..... 14196258

(51) Int. Cl.
*E05D 5/02* (2006.01)
*E06B 3/88* (2006.01)
(Continued)

(52) U.S. Cl.
CPC ..... *E06B 3/88* (2013.01); *E05D 5/0246* (2013.01); *E05D 7/081* (2013.01); *E06B 3/02* (2013.01);
(Continued)

(58) Field of Classification Search
CPC . E05D 5/0246; E05D 5/02; E05D 2005/0261; E05D 2005/0269; E05D 2005/0253; E05D 7/081; E05D 7/08; E05D 7/082; E05D 7/083; E05D 7/084; E05D 7/04; E05D 7/043; E05F 11/385; E05F 11/0054; E05Y 2900/114; E05Y 2900/132;
(Continued)

(56) References Cited

U.S. PATENT DOCUMENTS 2,154,716 A * 4/1939 Anderson ..... E05D 7/04 16/247
2,191,900 A * 2/1940 Pariot ..... E06B 3/02 16/253
(Continued)

FOREIGN PATENT DOCUMENTS

DE 8536840 U1 2/1990
DE 4335387 A1 4/1995
DE 102009022803 A1 12/2010

*Primary Examiner* — Chuck Mah
(74) *Attorney, Agent, or Firm* — Cantor Colburn LLP

(57) ABSTRACT

A corner fitting for a door element, in particular for a glass door element, includes a first fitting element and a second fitting element, which each include, at least sectionwise, a locating portion. The locating portion includes an intermediate layer able to contact the door element. The fitting elements delimit the restraining area, wherein a holding element is in operative connection with a connecting element, which serves for supporting the door element on a center of rotation and/or an axis.
At least one variably adjustable distancing element is disposed between the fitting elements outside the locating portions, wherein the distancing element forms a counterbearing to the locating portions and the door element, which can be restrained in the restraining area.

14 Claims, 6 Drawing Sheets

(51) Int. Cl.
*E05D 7/081* (2006.01)
*E06B 3/02* (2006.01)
*E06B 7/28* (2006.01)
*E05D 15/54* (2006.01)

(52) U.S. Cl.
CPC ..... *E06B 7/28* (2013.01); *E05D 15/54* (2013.01); *E05Y 2201/638* (2013.01); *E05Y 2201/696* (2013.01); *E05Y 2600/12* (2013.01); *E05Y 2600/20* (2013.01); *E05Y 2600/634* (2013.01); *E05Y 2800/178* (2013.01); *E05Y 2800/672* (2013.01); *E05Y 2900/132* (2013.01)

(58) Field of Classification Search
CPC ..... E05Y 2600/502; E05Y 2600/60; E05Y 2600/12; E05Y 2600/634; E05Y 2800/672; E05Y 2800/178; E05Y 2800/72; E06B 3/54; E06B 3/02; E06B 3/36; E06B 3/968; A47K 3/362; A47K 2003/367; A47F 3/12; A47F 3/125; Y10T 16/534; Y10T 16/5326; Y10T 16/554; Y10T 16/5323; Y10T 16/533; Y10T 16/5335; Y10T 16/5327
See application file for complete search history.

(56) References Cited

U.S. PATENT DOCUMENTS 3,555,733 A * 1/1971 Horgan, Jr. ..... E05D 5/0246 16/245
3,796,405 A * 3/1974 Rystad ..... E05D 15/0634 248/316.7
3,828,394 A * 8/1974 Horgan, Jr. ..... E05D 5/0246 16/241
4,513,474 A * 4/1985 Watabe ..... E05D 5/046 16/243
4,535,503 A * 8/1985 Narita ..... E05D 5/0246 16/109
4,689,853 A * 9/1987 Marinoni ..... E05D 5/0246 16/382
4,848,032 A * 7/1989 Bailor ..... B60J 1/17 49/350
4,977,642 A * 12/1990 Marinoni ..... E05D 5/0246 16/257
5,203,115 A * 4/1993 Marinoni ..... E05D 5/0246 16/236
6,381,909 B1 * 5/2002 Liao ..... E05D 5/0246 49/388
7,673,373 B2 * 3/2010 Chang ..... E05D 5/0246 16/250
2003/0213103 A1 * 11/2003 Cameron ..... A47K 3/36 16/382
2004/0221950 A1 * 11/2004 Mizusawa ..... E05F 11/385 156/272.4
2006/0277716 A1 * 12/2006 Sprague ..... A47K 3/36 16/252
2007/0107351 A1 * 5/2007 Garrett ..... E05D 5/0246 52/474
2011/0214254 A1 * 9/2011 Fellman ..... E05D 5/0215 16/252
2015/0043965 A1 * 2/2015 Mao-Cheia ..... E05D 5/0246 403/338

* cited by examiner

CORNER FITTING WITH VARIABLY ADJUSTABLE RESTRAINING AREA

TECHNICAL FIELD

The disclosure relates to a corner fitting for a glass door element.

BACKGROUND

Conventional corner fittings allow for disposing door elements having different thicknesses, in particular glass door elements with different glass thicknesses on a center of rotation or an axis. The glass doors are for example double-action glass doors, which are disposed by means of the known corner fittings for example on a BTS-axis next to a sidepanel. Mostly, the structure of the prior art corner fittings comprises two fitting elements, which each include a locating portion for the door element, wherein an intermediate layer, which at least in sections, corresponds to the contour of the locating portions and is surrounded by the locating portion, is inserted between the locating portions and the door element. Outside the locating portions, the fitting elements form a free space within a cutout of the door element, which space is utilized for accommodating for example an axis between the fitting elements. With the intention to be able restrain door elements, in particular glass door elements, of different thicknesses between the fitting elements, the prior art corner fittings are dimensioned such that in their delivery condition, i.e. in an initial position, they are able to accommodate a door element having a predetermined glass thickness, for example with a glass thickness of 15 mm. In the event, another glass door element having a glass thickness of 10 mm were to be restrained in a corner fitting adjusted to a glass door element of 15 mm, in the prior art corner fitting, the intermediate layer is reinforced for compensating for the difference between the glass thicknesses. Therefore, in the present example, the intermediate layers are increased on both sides of the glass door element by 2.5 mm. In this case, by increasing the intermediate layers, the fitting elements abutting on both sides against the door element, move away from the door element by respectively 2.5 mm. Together with the fitting elements, also the cover or covering elements, which surround the fitting elements, move away from the door element on both sides by respectively 2.5 mm. Accordingly, a gap of 2.5 mm is automatically created on both sides of the door element, namely between the surfaces of the door element and the cover or covering element, which cover the fitting elements on both sides. To prevent said gap creation, the delivered cover or covering element, which is configured with the corner fitting adjusted to a glass thickness of a door element of 15 mm, would have to be exchanged against a cover or covering element which is deeper drawn for both sides of the door element. In an extreme case, namely with a corner fitting adapted to a glass door element of 15 mm thickness, which is intended to be converted for accommodating a glass door element of for example 7 mm thickness, the intermediate layers would have to compensate for the difference between 15 mm and 7 mm. This means, the intermediate layer on both sides of the door element needs to be increased by 4 mm. Thereby, the construction depth of the prior art corner fittings is larger by 4 mm on both sides of the door element. In addition, the clamping effect of the door element between the fitting elements and thereby the durability of the prior art corner fitting is reduced on account of the ever increasing intermediate layers.

SUMMARY

Therefore, the present disclosure overcomes the above-described disadvantages of the state-of-the-art at least partially. In particular, the present disclosure provides a corner fitting, which allows an enhanced adjustability, namely the adjustment to door elements having different door leaf thicknesses, respectively different material thicknesses, in particular having different glass thicknesses, and in which the distance of the fitting elements to the restrained door element is constant independently of the door leaf thickness thereof.

Features and details, described in conjunction with the inventive corner fitting are obviously also valid in conjunction with the inventive method, and respectively vice versa, such that mutual reference is made, respectively can be made with respect to the disclosure of individual aspects of the disclosure.

The inventive corner fitting for a door element includes a first fitting element and a second fitting element, which each at least sectionwise include a locating portion, which comprises an intermediate layer able to contact the door element, and the fitting elements delimit a restraining area, wherein a holding element is in operative connection with a connecting element, which serves for supporting the door element on a center of rotation and/or an axis, includes the technical teaching that at least one variably adjustable distancing element is disposed between the fitting elements outside the locating portions, wherein the distancing element forms a counter-bearing to the locating portions and the door element restrained in the restraining area.

This solution offers the advantage that the variably adjustable distancing element, which may be for example a threaded pin or a threaded rod, serves as a counter-bearing between the fitting elements, i.e. within the door fitting, and thus the distance between the fitting elements and the door element, namely in particular in the area of the locating portions, which respectively comprise the intermediate layers, which the door element contacts, in relation to the door element remains always constant. According to the disclosure, this means, the intermediate layer always remains in the contact position with the door element, independently of the thickness of the door element restrained between the fitting elements, because the distancing element can be exchanged depending on the door leaf thickness, in particular can be variably adjusted corresponding to the glass thickness. Preferably, and corresponding to the door leaf thickness of the door element, the distancing element can be screwed into, respectively unscrewed from a mount, which is for example configured as a bore with internal thread in at least one fitting element. Thereby, the spacing of the fitting elements in relation to each other and thus the restraining area are adaptable to the door leaf thickness, respectively glass thickness of the door element to be restrained, by means of the screwable and unscrewable distancing element. However, adapting the inventive corner fitting for example to door elements having different door leaf thicknesses, for example glass door elements having different glass thicknesses, does not change the distance of the fitting elements in relation to the door element. This is advantageous in that a frame or cover surrounding the respective fitting elements is always abutting against the glass door element independently of the thickness thereof, because the intermediate layer, which is disposed in the usual way between the fitting elements and the glass door element always remains constant. Insofar, utilizing the variably adjustable distancing element will prevent a gap creation between the fitting elements and the door element. This means automatically that the construction depth of the inventive door fitting on both sides of the door element is always the same independently of the door leaf thickness, respectively the glass or material thickness of the door element restrained by the inventive corner fitting.

As the variably adjustable distancing element allows for adjusting the inventive corner fitting variably to the door leaf thickness, respectively glass thickness of the door element clamped by means of the door fitting, in advantageous manner the thickness of the intermediate layer, which is disposed between the fitting elements and the door element, i.e. in the clamping, respectively restraining area of the inventive door fitting, and is surrounded by the locating portions, can always remain constant, whereby according to the disclosure an exchange of the intermediate layer independently of the glass thickness of the restrained door element becomes obsolete. Advantageously, thereby independently of the door elements having different thicknesses restrained in the inventive corner fitting, a consistent stability of the corner fitting with consistent material thickness of the intermediate layer can be guaranteed. In addition to the always consistent intermediate layer on both sides of the door element and with a simultaneous increase of the variability, the system costs thereof are reduced.

Advantageously, the fitting elements have a mount provided outside the locating portions, at which mount the distancing element is disposed. Advantageously, the distancing element is non-positively and/or positively retained via at least one of its ends in a mount configured at the fitting element. With its other end, which is not retained in the mount, the distancing element preferably props up against the opposite fitting element. By shifting the adjustability to areas outside the locating portions, which respectively comprise at least one intermediate layer, advantageously, the inventive corner fitting, while keeping the intermediate layer and while keeping the restraining area, which is delimited by the fitting elements, can be adjusted by the variable adjustment of the distancing element, which is inserted into, respectively removed from the mounts disposed outside the locating portions.

In order to be able to dispose the distancing element, the mount, which can be configured in one or in both fitting elements or can be disposed at them, includes a reception into which the distancing element extends. Preferably, the reception is an aperture, for example a bore, a pocket-bore or a milling, the contour thereof, i.e. the shape thereof being preferably adapted to the exterior contour of the distancing element. Advantageously in case the distancing element includes a threaded means, for example in the shape of a threaded rod, the bore, respectively the milling is advantageously configured as an internal thread, in which the threaded means of the distancing element non-positively and/or positively engages, respectively is accommodated therein. The configuration of the distancing element with a threaded means in the shape of a threaded rod, which engages into a bore in the mount configured as an internal thread, should not be understood as delimiting, moreover all contours are conceivable for the distancing element, the exterior contour thereof being representable in the bore, respectively the milled portion in the fitting element or the mount, for forming a counter-holding means for the distancing element configured with a threaded or holding means, wherein in particular the holding or threaded means with the counter-holding means allows for a variable adjustment of the length of the distancing element. In this way, the inventive corner fitting can be adapted to door elements having different thicknesses without having to exchange the distancing element, without having to exchange the frame and the cover elements, and moreover without having to exchange the intermediate layers.

Preferably, the distancing element extends in an extension direction, which is oriented vertically to the longitudinal extension of the fitting elements, wherein the distancing element is variably adjustable in its length, which extends in the extension direction. Advantageously, the extension direction of the distancing element extends between the fitting elements, and more preferred parallel to the distance configured as a free space between the fitting elements. As the distance between the fitting elements is determined by the door element restrained between the fitting elements, the adjustment of the length of the distancing element is realized proportionally to the changing distance between the fitting elements. Preferably, as the distancing element includes a threaded means, and following the changing distance of the fitting elements, the distancing element in its length, which extends in its extension direction, can preferably infinitely variably follow the changing distance between the fitting elements. The mounting safety on-site can be thereby considerably increased, because the inventive corner fitting and without additional structural components or structural sets in its delivery condition can be variably adapted to the material thicknesses of the door elements to be installed, whether or not the material thickness of the door elements correspond to the known standards.

Advantageously, the fitting elements are embodied with a lower recess, in which the connecting element is displaceable, wherein in particular a bottom area forms as a free space between the fitting elements, and the bottom area, in which the distancing element and/or the mount is/are disposed are located approximately on the same height as the lower recess. In this case, the lower recess is preferably formed in both fitting elements and extends over the distance of the fitting elements from the one to the other fitting element. Advantageously, the lower recess serves at least sectionwise for displacing the connecting element together with the holding element in longitudinal extension of the fitting elements. For guaranteeing a displacement of the connecting element over the entire length of the lower recess, the contour of the lower recess is adapted to the exterior contour of the connecting element. In case the exterior contour of the connecting element presents for example rounded corners, the contour of the recess has rounded corners as well, which correspond to the shape and the radius of the rounded corners of the exterior contour of the connecting element. In addition and advantageously, the rounded corners of the contour of the recess serve for preventing jamming of the connecting element in the border areas of the lower recess. Therefore, the lower recess guarantees that the connecting element, without getting in contact with the glass door element, can be displaced in the cutout formed by means of the glass door element, preferably in longitudinal extension of the fitting elements in the free space formed in the bottom area. With the intention to dispose the distancing element without having contact to the glass door element between the fitting elements, it is advantageously suggested to dispose the distancing element or the mount, which accommodates the distancing element, almost at the same height as the lower recess in the free space formed between the fitting elements preferably in the bottom area. Advantageously in this case, the mount is disposed in direct adjaceny to the lower recess at or at least in one of the fitting elements.

With the intention to not only configure, punctually via only one distancing element, a counter-bearing to the locating portions and to the door element restrained in the restraining area, it is advantageous to dispose at least one second distancing element between the fitting elements, which is placed almost parallel to the first distancing element at the same height. Thus, for example with a glass cutout "universal", a first distancing element could be disposed between the fitting elements at the exterior border of the corner fitting. A second distancing element could then be disposed at the same height approximately parallel to the first distancing element at the opposite exterior border between the fitting elements. The two distancing elements together will then form a counter-bearing to the locating portions and to the door element restrained in the restraining area, whereby altogether the stability of the inventive corner fitting is increased.

Advantageously, the distancing elements are disposed on both sides of the lower recess in the free space formed between the fitting elements in the bottom area. Moreover, the distancing element may be disposed at least via the threaded means in a mount at one fitting element to be screwable and unscrewable, wherein then the other distancing element with the threaded means can be disposed at the other fitting element to be screwable and unscrewable.

It is for example conceivable that the inventive corner fitting is structurally configured for a glass door element having a certain glass thickness, for example a glass thickness of 8 mm, such that the fitting based on said structural configuration in the delivery condition is fully functional without unscrewing the distancing element from a mount configured as a bore in the fitting element, wherein outside the locating portions, the fitting elements are abutting against each other at least sectionwise. For adapting the mentioned corner fitting to door elements having a thicker glass thickness, for example a glass thickness of 15 mm, the distancing elements are unscrewed from the mount configured as a bore in the fitting element, namely so far until they are adapted to the thickness of the 15 mm thick glass door element, namely until the part of the distancing element unscrewed from the mount corresponds to the difference between the exemplary 8 mm thick glass door element and the exemplary 15 mm thick glass door element. In the described case, the distancing element would have to be unscrewed by 7 mm from the mount, which is configured as a bore in the fitting element, for bridging the distance of 7 mm between the fitting elements. In other words, this means that the distancing element, respectively the distancing elements is/are variably adjustable following the spacing of the fitting elements, which is given by the thickness of the inserted door element.

In advantageous manner, the mount forms a common structural component with the fitting element, wherein advantageously the structural component is configured integrally and/or monolithic. In this case, for example a structural component manufactured in an injection molding process from one or more different components is to be understood as a monolithic structural component. A structural component manufactured from a material, which for example is carved out from the material by machining a material, for example a metal block, can be understood as an integral structural component. Preferably, a common structural component is also understood in that the mount and the fitting element are configured as individual parts, which are provided as a common structural component in a pre-mounted condition.

As the inventive corner fitting is preferably configured for supporting a door element on an axis, respectively a center of rotation, advantageously, the corner fitting comprises a holding element, which is in operative connection with a connecting element, by means of which the door element restrained in the restraining area between the fitting elements can be aligned to the center of rotation and/or an axis of rotation. Preferably in this case, the connecting element is connected via attaching elements to a holding element, which allows for the infinitely variable adjustment of the door element to non-standard centers of rotation. Preferably, said interconnected structural components form an attaching mechanism, which is advantageously incorporated at both structural components, namely at the holding element and at the connecting element, and which mechanism can be transferred between a released condition and a fixing condition, wherein the holding element is displaceable at the fitting elements in the released condition, and in the fixing condition, it is at least non-positively and/or positively attached to at least one fitting element. Accordingly, on the one hand, the attaching mechanism formed at the holding element and at the connecting element advantageously serves for infinitely variably adjusting the corner fitting to a center of rotation and/or an axis, i.e. for infinitely variably displacing the holding element and the connecting element connected to the holding element, in particular in relation to the longitudinal extension of the fitting elements. Moreover, the attaching mechanism serves for fixing the corner fitting in the adjusted position, namely for fixing the holding element via the attaching mechanism at least at one of the fitting elements at least non-positively and/or positively. Accordingly, for adjusting the connecting element to the center of rotation and/or the axis, the holding element can be guided freely displaceable with the connecting element, i.e. according to the disclosure, infinitely variably displaceable with regard to the longitudinal extension of the fitting elements. Once the position of the connecting element is adjusted to the center of rotation and/or the axis, immobilizing the holding element and thereby also at least indirectly of the fitting element is realized via the attaching mechanism in form of a non-positive clamping connection with at least one of the fitting elements via the holding element, which is preferably configured as a clamping plate.

For establishing an operative connection between the holding element and the connecting element, i.e. for forming the attaching mechanism, the holding element and the connecting element are particularly advantageously non-positively and/or positively connected to each other via at least one attaching element. The attaching element between the holding element and the connecting element may be for example a screw, such as e.g. a headless screw, which connects the holding element and the connecting element to each other. Particularly advantageously, at least two attaching elements are provided, which connect the holding element to the connecting element. For adjusting the attaching mechanism, in particular for transferring the attaching mechanism from the released condition into the fixing condition and vice versa, preferably the attaching elements are disposed at the connecting element to be accessible for the user from outside. As the connecting element is in operative connection with the holding element, which is guided between the fitting elements, and is therefore difficult to access, advantageously via the attaching elements accessible from outside at the connecting element, the attaching mechanism and in particular the holding element can be transferred from its fixed condition, i.e. the clamping with the free space configured as a recess, into the released condition, i.e. for establishing the infinitely variable displaceability in longitudinal extension of the fitting elements, and vice versa.

The non-positive and/or positive connection between the holding element and the connecting element, i.e. the transfer of the attaching mechanism from the released condition into the fixing condition, serves in addition in an advantageous manner for immobilizing the holding element at the attaching element. Preferably for this purpose, the attaching element includes a free space as a guide, for example in the shape of a recess, a groove or a rail, at which, respectively in which the holding element is guided, respectively supported to be movable. Advantageously, in this case, the free space in the fitting element is configured such that the holding element is displaceable, respectively guidable in longitudinal extension of the fitting element. As the fitting element, respectively the fitting elements of the corner fitting are aligned parallel to the front and/or rear surface of the door element, the displacement of the holding element in longitudinal extension of the fitting element causes a displacement of the door element with the fitting element in the opposite direction to the displacement of the holding element in the longitudinal extension of the fitting element. Thereby, it will be possible to align the door element, for example within a door casing to the long sides of the casing and to the center of rotation and/or the axis. If said displaceability of the door element in relation to the center of rotation was not given, for example a double-action door, set on a firm center of rotation and/or a firm axis, with one of its edges could unintentionally contact a wall or another structural glass element, in case of an incorrect position of the center of rotation and/or the axis. In the event an abutment of the double-action door is configured at least partially at another glass door element or at the wall, in case of incorrect adjustment of the corner fitting or in case of incorrect position of the center of rotation and/or the axis, the door element would pivot past the abutment.

Advantageously, the holding element is configured as an L-profile with a head part and a connecting part, preferably in the shape of two surfaces essentially orthogonally to each other, i.e. meaning that the head part is vertically aligned to the connecting part, wherein the head part is supported in the free space configured as a groove, a slot or a recess in one of the fitting elements to be movable in the released condition of the attaching mechanism, and, in the fixing condition of the attaching mechanism, acts in a clamping manner in the recess. In the event both respective fitting elements each include a free space configured as a groove, a slot or a recess, the head part of the holding element, respectively the holding element is advantageously configured as a T-profile, for supporting the holding element to be movable in both recesses of the fitting elements, respectively for clamping it. By transferring the attaching mechanism from its released condition into the fixing condition, the holding element configured as a T-profile on both sides, i.e. in both free spaces configured as a groove, a slot or a recess of the fitting elements, offers at least sectionwise a resting portion, which serves for the non-positive and/or positive connection between the holding element and the fitting elements. In this case, preferably in the fixing condition of the attaching mechanism, the head part of the holding element acts in a clamping manner in both grooves, slots or recesses. In contrast to the holding element configured as an L-profile, the holding element configured as a T-profile clamps equally on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. As also already described for the holding element configured as an L-profile, in the holding element configured as a T-profile, via the fitting element, the connecting element is connected to the holding element via a connecting part.

In preferred manner, the free space is configured in at least one of the fitting elements as a recess. Preferably in this case, the recess extends in longitudinal extension of the fitting element and in a particularly advantageous manner respectively in longitudinal extension of both fitting elements, wherein preferably the recesses are configured in the two fitting elements at the same height and parallel to each other. The free space in the fitting elements, referred to as recess, is particularly preferred configured as a groove or a slot, and advantageously serves for guiding the holding element essentially parallel to the fitting elements and in relation to the longitudinal extension thereof. Advantageously, for this purpose the holding element includes the head part, which serves for supporting the holding element, at least in the released condition of the attaching mechanism, to be movable in the recess of one fitting element or of both fitting elements.

In advantageous manner, the attaching mechanism is configured such that, in the released condition, a static friction is effective between the holding element and the recess, which is considerably weaker than the static friction, which is effective in the fixed condition between the holding element and the recess. Preferably, the attaching elements and even more preferred at least two attaching elements serve for increasing the static friction from the released condition into the fixed condition of the attaching mechanism, via which attaching elements the static friction is adjustable between the recess and the holding element. If for example the attaching element configured as a screw is screwed into the holding element via the connecting element, preferably the static friction is increased between the holding element and the recess. When unscrewing the attaching element, the static friction between the holding element and the recess is advantageously lowered and the attaching mechanism is transferred into the released condition.

Preferably, the static friction between the holding element and the recess is increased until the holding element is fixed at least at one of the fitting elements via the attaching mechanism. In this case, advantageously in the fixing condition, a clamping is effective between the holding element and the recess, wherein the clamping prevents a movement of the holding element in relation to the fitting element. With the clamping and the fixed positioning of the holding element in the fixing condition of the attaching mechanism, advantageously also the connecting element being in operative connection with the holding element is fixed in its position in relation to the fitting elements.

Based on a compact embodiment of the inventive corner fitting requiring only little constructional space, preferably, the attaching mechanism is configured in that, during the transfer from the fixing condition into the released condition and vice versa, the holding element performs a stroke movement within the free space. As the attaching mechanism is advantageously incorporated in the holding element and in the connecting element, no additional structural components are required for forming the attaching mechanism. In this case, advantageously, in addition to serving for infinitely variably guiding the holding element in longitudinal extension to the fitting elements, the free space configured as a recess in the fitting elements also serves for accommodating the holding element in an at least clamping manner and namely advantageously at any position in the recess.

Advantageously, the connecting part and the head part of the holding element are configured as a common, monolithic and/or integral structural component. In this case, for example a structural component manufactured in an injection molding process from one or more different components is understood as a monolithic structural component. A structural component manufactured from a material, which component for example is machined out from the material block by milling, for example a material block, for example a metal block, can be understood as an integral structural component. Preferably, a common structural component is understood in that the head part and the connecting part are configured as individual parts, which are provided as a common structural component, namely as the holding element in a pre-mounted condition.

As the maximum spacing of the fitting elements, respectively the maximum dimension of the distancing elements is limited by the resting portion of the holding element, the resting portion of the holding element is at least dimensioned such that the dimension allows for a spacing of the fitting elements from an initial position plus/minus 10 mm, preferred plus/minus 15 mm and particularly preferred plus/minus 20 mm. This means that resting portions of the holding element in T-profile shape, which are guided for example on both sides in the recesses of the fitting elements, can be moved out of the recesses of the fitting elements by respectively at least 5 mm mm. In the event, however, the inventive corner fitting is intended for additionally compensating for a plane offset between the door element and for example an adjoining sidepanel, it is advantageous, if the resting portions of the holding element, which are guided on both sides in the recesses, are dimensioned such that they can be moved on both sides, i.e. respectively out of the one or the other fitting element, respectively out of the recesses of the fitting element by at least 10 mm, respectively can be moved into the recesses of the opposite fitting element.

The principle of variability of the restraining area should be understood according to the idea of the present disclosure to be applicable to corner fittings and in particular to all door fittings no matter what type and shape. In particular locks and lock strike boxes, which need to be clamped to door leaves of different thicknesses, in particular to glass doors having different glass thicknesses, respectively dimensions are understood as door fittings. In this case, the features mentioned in the description, as well as the features of the corner fitting, which are shown and described in the Figures, can be applied individually or in any combination to the door fittings as well.

In the present application the following terms are understood as follows:

A structural component, which extends in a variably adjustable measure between the fitting elements and thereby allows for adjusting the inventive corner fitting to different material thicknesses of a door element or to other elements, such as a sidepanel or an overpanel of an all-glass door installation, is understood as a "variably adjustable distancing element".

A distancing element and preferably at least two or more distancing elements are understood as "distancing element". The one distancing element, respectively the distancing elements may be non-positively and/or positively, and in particular non-positively and positively accommodated at the fitting elements on alternating sides and prop up at the other fitting element. Obviously, the distancing elements could be accommodated just in mounts at only one fitting element and would then prop up at the opposite fitting element.

A structural component, which is movable essentially parallel to the fitting elements, i.e. displaceable and advantageously also rotatable, is understood as the "holding element" and which serves for displacing the connecting element, which is operatively connected to the holding element, parallel to the fitting elements and for aligning it with a door element restrained in a restraining area about a center of rotation and/or an axis. In this case, the holding element may be configured as a single-surface or multi-surface body. Obviously, the holding element may as well be configured of one or more struts connected to each other or otherwise, such as an angled part. The space available between the fitting elements and formed by the distance of the fitting elements to each other is the only limiting factor for the type and construction form of the holding element.

A structural component accommodating the center of rotation and/or the axis is understood as the "connecting element". For increasing the variability of the connecting element, said reception may have different sizes, respectively may be adaptable to receptions having different sizes, for example by means of adapter inserts. The connecting element may thus be a separate structural component, which is in operative connection with the holding element via attaching elements, or it may as well be embodied with the holding element as a common monolithic and/or integral structural component.

The inventive corner fitting is not only intended to serve for adapting of the restraining area to door elements having different thicknesses, in particular different glass thicknesses, but should also be configured in that the fitting can be adjusted to an infinitely variable selection of different centers of rotation and/or an centers of axis, i.e. to different pivot center dimensions in a range of approximately 45 mm to 80 mm. In addition, the inventive corner fitting is intended to adjust a plane offset between the door element and for example a sidepanel. The inventive corner fitting should also compensate for an angle offset of the door element to the sidepanel or to the door casing, i.e. be adjustable.

A free space configured in the shape of grooves, small channels, furrows, shoulders, rails, protrusions, slots and/or for example roller belts, which allows for a displaceable, i.e. mobile support of the holding element, may be understood as the "free space, which is configured as a recess in at least one fitting element". Obviously, latching means may be provided along the free space, which allow for the holding element to latch in and thus for a pre-adjustment of the door element to given dimensions of points of rotation and/or dimensions of axes. However, it might be that just latching and/or stop points are configured for standardized centers of rotation and/or the axes. In this case, a infinitely variable displaceability of the holding element in the free space is guaranteed advantageously between two latching means, respectively between two latching and/or stop points, whereby a fine-tuning of the corner fitting is possible to non-standardized centers of rotation.

The method for adjusting a corner fitting to a door element, for accommodating different material thicknesses of the door element in the corner fitting, includes a first fitting element and a second fitting element, which each, at least sectionwise, include a locating portion, which comprises an intermediate layer able to contact the door element, and the fitting elements delimit the restraining area, wherein a holding element is in operative connection with a connecting element, which serves for supporting the door element on a center of rotation and/or an axis, at least one variably adjustable distancing element being disposed between the fitting elements outside the locating portions, wherein the distancing element forms a counter-bearing to the locating portions and the door element, which can be restrained in the restraining area, includes the following steps:

1) dismounting the fitting elements,
2) adjusting the distancing element, wherein the longitudinal extension of the distancing elements is changed,
3) mounting the fitting elements.

Advantageously, the method is facilitated by using the inventive corner fitting in that no structural components need to be exchanged for adjusting the corner fitting to different door elements having different glass thicknesses. In addition, dismounting and mounting the fitting elements is simplified in that they just need to be loosened from each other until the distance between the fitting elements is adapted to the material thickness of the door element. Advantageously, loosening the distancing elements from each other will not be necessary, in particular not, if adjusting the distancing element or the distancing elements can be performed from the outside. Thus, for example the mount, which serves for accommodating the distancing element at the fitting elements, could be configured as a bore passing through the fitting elements, which bore allows for introducing a tool to the distancing element. The distancing element can be screwed into or unscrewed from the mount or moved, respectively displaced in another way by means of the tool.

With the intention to avoid repeating the advantages of the inventive method, it is referred to the description of the advantageous embodiment of the inventive corner fitting and it is fully and comprehensively referred to the latter.

Hereinafter, further measures enhancing the disclosure will be illustrated in more detail in conjunction with the description of preferred embodiments of the disclosure based on the Figures. In this context, the features mentioned, individually or randomly combined, may be essential to the disclosure.

BRIEF DESCRIPTION OF THE DRAWINGS

In the drawings.

Throughout the different Figures, same parts are always identified by the same reference numerals, and therefore they will be normally only described once.

DETAILED DESCRIPTION OF THE DRAWINGS

Figure 1B:
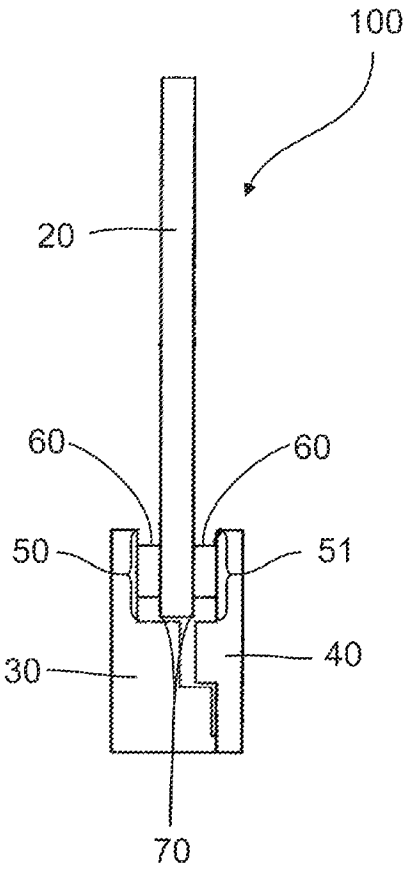
FIGS. 1 A and B show a door fitting as a corner fitting known from the state-of-the-art, which serves for accommodating of door element having different door leaf thicknesses, while inserting different intermediate layers.
Figure 1A:
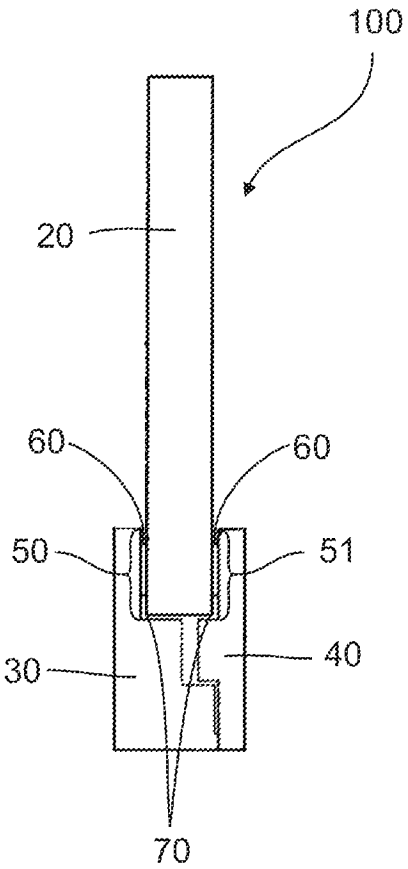

FIGS. 1 A and B illustrate a corner fitting 100 known from the state-of-the-art in a frontal view with the part of the corner fitting 100 to be disposed on a center of rotation. The corner fitting 100 comprises two fitting elements 30 and 40, which engage in each other in the lower part via a contour. By means of said contour, the fitting elements 30 and 40 form a reception area, respectively a restraining area 70 for a door element 20. For this purpose, the fitting elements 30 and 40 include respective locating portions 50 and 51, which each abut on both sides against the door element 20 indirectly via an intermediate layer 60. In the frontal view on the corner fitting 100, illustrated in the FIGS. 1 A and B, just the part of the locating portions 50 tapering towards the axis of rotation can be seen. As the locating portions 50 and 51 taper in the direction of a reception for the axis of rotation, below the door element, which includes a cutout, the contour thereof following approximately the locating portions 50, a free space is formed in the frontal part of the corner fitting 100, illustrated in FIGS. 1 A and B, below the door element 20 for being able to accommodate the corner fitting 100, respectively to dispose it on an axis of rotation, respectively a center of rotation.

As shown in FIG. 1 A, the corner fitting 100 known from the state-of-the-art is structurally designed for a door element 20 having a relatively thick glass thickness. This means that the thickness of the intermediate layers 60 can be kept as small as possible, so that a cover placed onto the fitting elements 30 and 40, which surrounds the fitting elements 30 and 40, abuts against the surfaces of the door element 20. In the present case, the cover surrounding the fitting elements 30 and 40 is not illustrated. In case it is desired to utilize the corner fitting 100 illustrated in FIG. 1 A for disposing a door element 20 on a center of rotation, respectively an axis of rotation, and the door element 20 has a smaller glass thickness, the known corner fitting 100 needs to be adapted to the smaller glass thickness of the glass door element by means of intermediate layers 60, wherein the intermediate layers 60 need to be correspondingly thicker, to be able to accommodate, respectively to restrain the glass door element as illustrated in FIG. 1 B, which has a smaller glass thickness than the door element 20 illustrated in FIG. 1 A, in the restraining area between the fitting elements 30 and 40. A cover, respectively a cover element, as the one that would be used in FIG. 1 A for covering the fitting elements 30 and 40, would not abut anymore against the glass door element 20 such that a gap would be visible between the cover and the surfaces of the glass door element 20, and forms on both sides of the door element. In addition, a thicker intermediate layer 60 would result in that clamping, respectively restraining the door element 20 between the fitting elements 30 and 40 in the restraining area 70 would become more unstable, which would in particular affect the longevity of the corner fitting 100. In the extreme case, the material properties of the intermediate layers 60 would change over the time of operational demands on the known corner fitting 100 such that the door element 20 tilts out of the clamping, respectively restraining area 70 and thereby damages for example a floor or gets damages itself. This could be possibly counteracted in that, in case of operational demand on the known corner fitting, the connection between the fitting elements 30 and 40 would be readjusted to press for example an intermediate layer 60 that became brittle or softer with a higher pressure against the surfaces of the door element 20 restrained in the restraining area 70. Also, even if the corner fitting 100 known from the state-of-the-art would be able to solve the indicated problems, namely for example with a cover element drawn deeper, which would abut against the surfaces of the door element 20 when restraining narrower glass door elements 20, and if the materials of the intermediate layers 60 would be improved insofar that they would keep the material properties over the period of operation of the known corner fitting 100, it is still disadvantageous that with narrower door elements 20, i.e. with door elements 20 having a smaller glass thickness, the construction depth of the corner fitting 100 would increase when inserting thicker intermediate layers 60.

FIGS. 2 to 5 illustrate an inventive corner fitting 1, which solves the problems of a corner fitting 100 known from the state-of-the-art.

Figure 2:
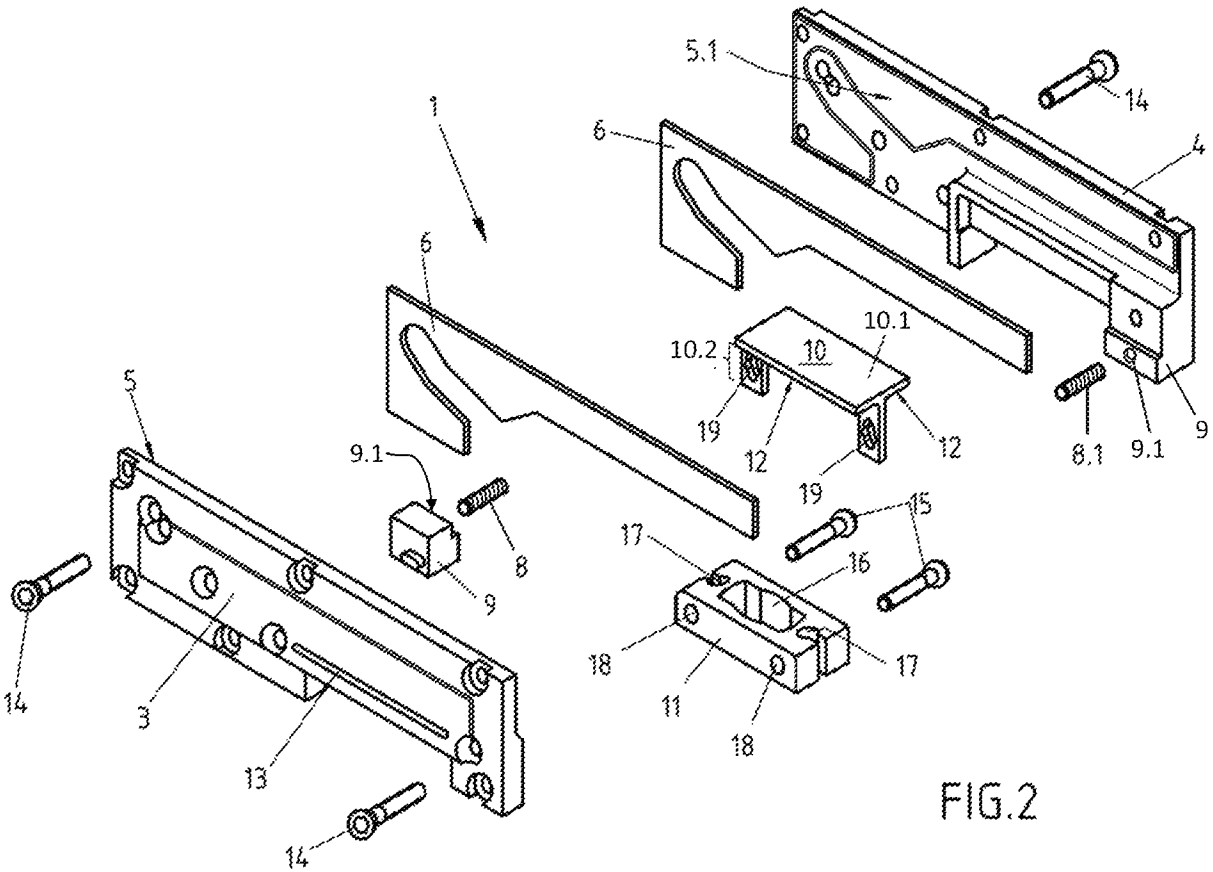
FIG. 2 shows an exploded view of the essential structural components of an inventive door fitting, which is configured as a corner fitting, wherein the structural components serve for forming a restraining area and for disposing the corner fitting on a center of rotation, FIGS. 3 A and B show the reception of a glass door element with a universal glass cutout in the corner fitting of FIG. 2, wherein the fitting element shown in FIG. 2 on the top right is not illustrated, in a top view from the bottom in A), and in a lateral view in B), FIGS. 4 A and B show the corner fitting of FIG. 2 with just one distancing element with a glass door element with Italian glass cutout, wherein the fitting element shown in FIG. 2 on the top right is not illustrated, in A) in a top view from the bottom, and in B) in a lateral view in, and FIGS. 5 A and B show the corner fitting of FIG. 2 in a frontal sectional view, wherein in A) a glass door element having a glass thickness of approximately 15 mm is restrained, and in B) a door element having a glass thickness of approximately 8 mm is restrained.

FIG. 2 shows an exploded view of an inventive corner fitting 1 without the frame surrounding the fitting elements 3 and 4 and without a cover element attached to the frame. At the fitting elements 3 and 4, the inventive corner fitting 1 comprises locating portions 5 and 5.1 configured at least sectionwise, which serve for locating against a door element 2, which is disposed between the fitting elements 3 and 4 and disposed on an axis of rotation, respectively a center of rotation. As the fitting elements 3 and 4 are preferably made from metal, a metal alloy or also for example a plastic material metal alloy, the locating portions 5 and 5.1 respectively comprise an intermediate layer 6, which is between the locating portions 5 and 5.1 and the door element 2. As the door element 2 is preferably a glass door element, on the one hand the intermediate layer serves for preventing the contact of metal on glass. On the other hand, the intermediate layers 6 assist the dampening properties of the inventive corner fitting 1, increase the friction quotient between the glass door element and the fitting elements 3 and 4, and also when the elasticity is lower, they serve as screw securing for the attaching means 14, by means of which the fitting elements 3 and 4 are preferably connected to each other. Preferably, the intermediate layers 6 are made from a plastic material or a rubber elastic material for this purpose. Obviously, the intermediate layers 6 could be configured from ferroelastic soft materials or metal elastomer compounds. In particular, when utilizing the inventive corner fitting 1 for disposing glass door elements 2, which serve as fire-rated doors, highly durable metal elastomer compounds could be of importance for the intermediate layers 6. Respectively one mount 9, which serves for disposing, i.e. for the non-positive and/or positive reception of the variably adjustable distancing elements 8 and 8.1, is intended in the lower area of the fitting elements 3 and 4. In the fitting element 4, the mount 9 is a recess in the shape of a pocket bore with an internal thread. The mount 9 illustrated for the fitting element 3 for disposing, i.e. for the non-positive and/or positive reception of the variably adjustable distancing element 8, is configured as a separate structural component, which engages, respectively can be inserted into for example into a bore, in particular into a pocket hole configured at the fitting element 3. The mount 9 of the fitting element 3, just like the mount 9 of the fitting element 4, includes a recess with an internal thread configured therein for the non-positive and/or positive connection to the variably adjustable distancing elements 8 and 8.1. As illustrated in the following FIGS. 3 and 4, depending on the glass cutout of the door element 2, the mount 9 inserted into the fitting element 3, respectively the distancing element 8 disposed at the fitting element 3 via the mount 9, can be optionally foregone, which, however, does not affect the functioning of the remaining distancing element, in this case the distancing element 8.1, nor does it affect the functioning of the corner fitting 1. By screwing, respectively unscrewing the distancing elements 8 and 8.1 into respectively out of the recess configured as an internal thread of the mount, the distance between the fitting elements 3 and 4, which is given by the material thicknesses of the door element 2 restrained there between, can be variably and preferably infinitely variably replicated, such that the variable distancing elements 8 and 8.1, without having to replace them, form a fully functional counter-bearing to the locating portions 5 and 5.1 and the door element 2 which can be restrained in the restraining area 7, and always depending of the material thickness of the door element.

A connecting element 11, which is operatively connected to a holding element 10, serves for supporting the door element 3 on the center of rotation 2 and/or the axis. The holding element 10 includes a head part 10.1 and a connecting part 10.2. In the present case, the connecting element 11 is non-positively and/or positively operatively connected at the connecting part 10.2 to the holding element 10 and together with the connecting element 11 forms the attaching mechanism. The holding element 10 being in operative connection with the connecting element 11 is supported via the head part 10.1 to be movable in a free space 13 configured as a recess in the shape of a groove in the fitting element 3 and the fitting element 4. In this case, the free space 13 is configured in the shape of recess configured as a groove parallel to the longitudinal extension of the fitting elements 3 and 4. The holding element 10 and the connecting element 11, which is in operative connection via the attaching elements 15, are thereby displaceable parallel in the free space 13, i.e. with regard to, respectively in the longitudinal extension of the fitting elements 3 and 4. As the connecting element 11 with the holding element 10 is displaceable in relation to a restrained door element 2 in the opposite direction, the door element 2 can be infinitely variably aligned to a center of rotation for example in its position in a door frame or an all glass installation. In the event e.g. the center of rotation, respectively the axis of rotation of the door element 2 is located outside the ranges determined for the usual standardized centers of rotation, namely outside of 55 mm, 65 mm or 70 mm, the door element 2 may be aligned to the center of rotation and/or the axis by displacing the holding element 10 with the connecting element 11, which is operatively connected to the holding element 10. In the present case, the holding element 10 and the connecting element 11 are configured as two interconnected structural components comprising the attaching mechanism, which presently is incorporated in both structural components, namely in the holding element 10 and in the connecting element 11. For transferring the attaching mechanism form the released condition, in which the holding element 10 is movable in the longitudinal extension of the fitting elements 3 and 4 in the free space 13 configured as a recess, into the fixing condition, the attaching elements 15, which connect the holding element 10 via the connecting part to the connecting element 11, are screwed into the through-holes 18. When screwing the attaching elements 15 into the connecting part 10.2 of the holding element 10, the head part 10.1 of the holding element gets clamped at least sectionwise non-positively in the free space 13 configured as a recess in the form of a groove or a slot, on both sides of the fitting elements 3 and 4. Thus, in the fixing condition of the attaching mechanism, the displaceability of the holding element 10 and of the connecting element 11 operatively connected to the holding element 10 is disabled, respectively the holding element 10 is immobilized at the fitting elements 3 and 4.

As already described, attaching elements 15, which pass through through-holes 18 in the shape of bores configured in the connecting element 11, serve for the non-positive and/or positive connection between the connecting element 11 and the holding element 10. Advantageously, the through-holes 18 or bores are embodied in the shape of internal thread bores. Advantageously, the attaching elements 15 configured in the shape of screws engage in the through-holes 18 embodied as internal thread bores. For disposing the door element 2 on a center of rotation and/or an axis, a reception 16 is configured almost in the center of the connecting element 11. Advantageously in this case, the reception 16 is adaptable to the center of rotation and/or the axis, for example by means of different adapter inserts.

As, in the present exemplary embodiment, the connecting element 11 is a single component of the corner fitting 1, obviously the latter may be variably connected also with differently sized receptions 16 to the holding element 8. For connecting the holding element 10 to the connecting element 11, the connecting element 11 has apertures 17 configured in the area of the through-holes 18, which serve for accommodating the connecting part 10.2 of the holding element 10, which in the present case is configured as a tappet. The tappets have respectively one bore 19, through which the attaching elements 15 engage, which are guided in the through-holes 18 and thereby non-positively and/or positively connect the connecting element 11 to the holding element 10. The head part 10.1 of the holding element disposed orthogonally to the connecting part 10.2 is guided, respectively retained in the free space 13 configured as a recess in the fitting elements 3 and 4. For this purpose, the head part 10.1 has resting portions 12, which reach abutment at locating surfaces configured in the free space 13. By tightening the attaching elements 15 and by the resting portions 12 of the head part 10.1 of the holding element 10 abutting against the locating surfaces of the free space 13 of the fitting elements 3 and 4, an increased static friction is generated between the resting portions 12 of the head part 10.1 of the holding element 10 and the locating surfaces of the free space 13, and thus results in a non-positive connection between the holding element 10 and the fitting elements 3 and 4. The non-positive connection between the holding element 10 and the free space 13 of the fitting elements 3 and 4 may be even increased in that the resting portions 12 of the head part 10.1 of the holding element 10 include a ribbing on the surface, for example a diamond-shaped ribbing, which engages in a ribbing configured in the locating surfaces of the free space 13 such that in addition to the non-positive connection also a positive connection is created between the holding element 10 and the fitting elements 3 and 4. For increasing the clamping, i.e. the friction effect between the holding element, in particular between the engaging, respectively resting portion 12 and the free space 13 configured as a recess 11, advantageously, the engaging, respectively resting portion 12 includes a ribbing. Obviously, the clamping of a holding element 10 configured as a clamping plate, may just be effected by a non-positive connection.

Figure 3A:
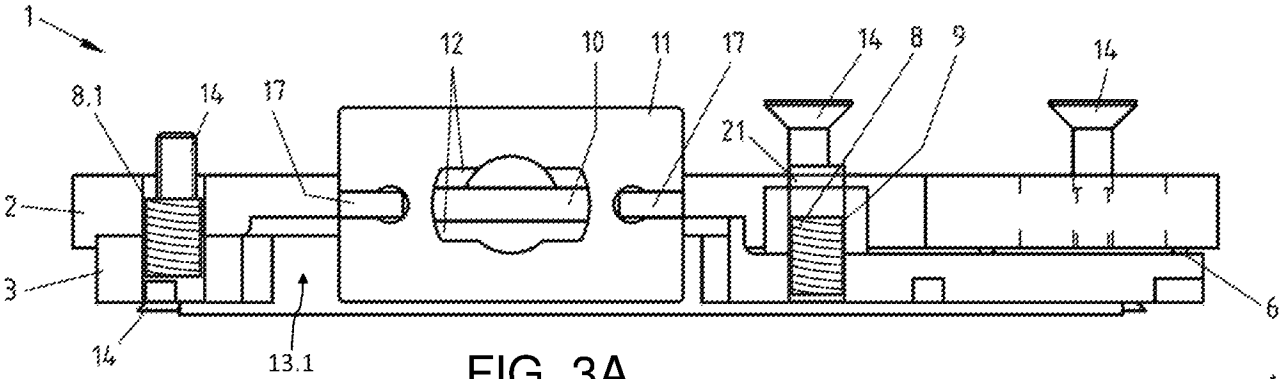
Figure 3B:
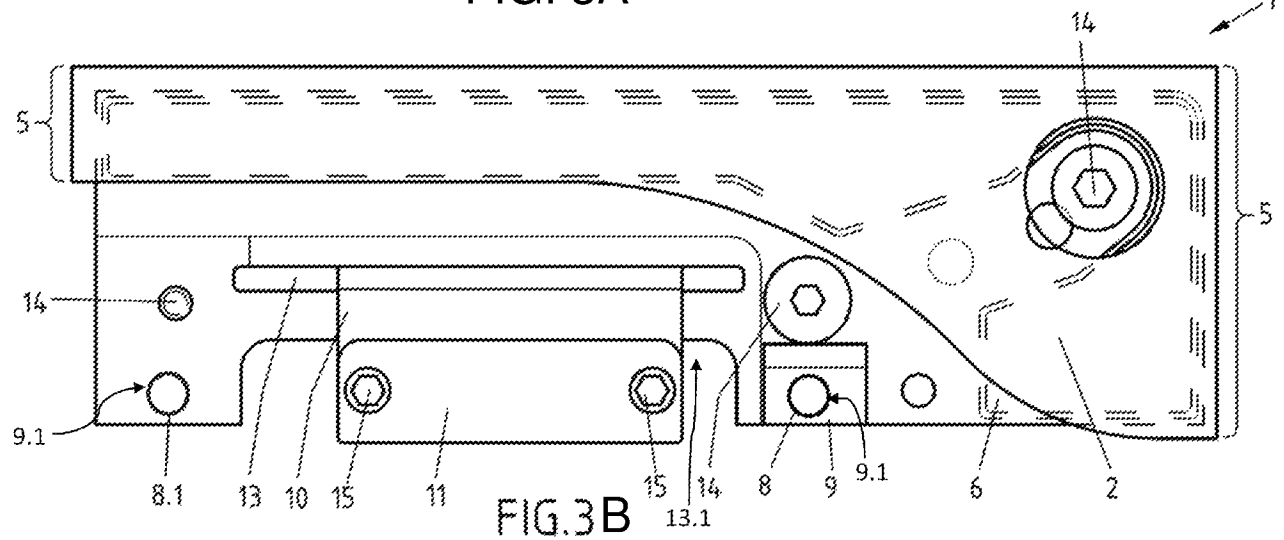

The FIGS. 3 A and B show the corner fitting 1 illustrated in FIG. 2 without the fitting element 4, in A in a top view from the bottom and in B in a lateral view. Also a frame surrounding the fitting element 3 and a cover, respectively a cover element fitted onto said frame are not illustrated in FIGS. 3 A and B for the sake of clarity. As illustrated in the FIGS. 3 A and B, the distancing elements 8 and 8.1 are disposed parallel to each other outside the locating portion 5 almost at the same height of a lower recess 13.1 in the bottom area 13.2 of a free space formed between the fitting elements 3 and 4. In this case, the lower recess 13.1 serves for the displaceability of the connecting element 11 with the holding element 10 parallel to the longitudinal extension of the fitting elements 3 and 4. The locating portion 5 is adapted to the glass cutout of the door element 2 restrained in the corner fitting 1. The locating portion 5 just as the intermediate layer 6, which is surrounded by the locating portion 5, in the right part illustrated in FIG. 3, extend over the entire height of the fitting element 3 and taper to the left and following the glass cutout, such that below the glass cutout, the free space is created for the reception of the holding element 10 and the connecting element 11, which is operatively connected to the holding element 10, as well as for disposing the distancing elements 8 and 8.1 between the fitting elements 3 and 4. In the present case, the glass cutout configured in the door element 2 is a "universal" glass cutout. As the extension of the variably adjustable distancing elements 8 and 8.1 is adaptable to the glass thickness of the restrained door element 3, all door elements with a "universal" glass cutout having different glass thicknesses can be restrained by the inventive corner fitting 1 and be disposed for example on an axis of rotation.

Figure 4A:
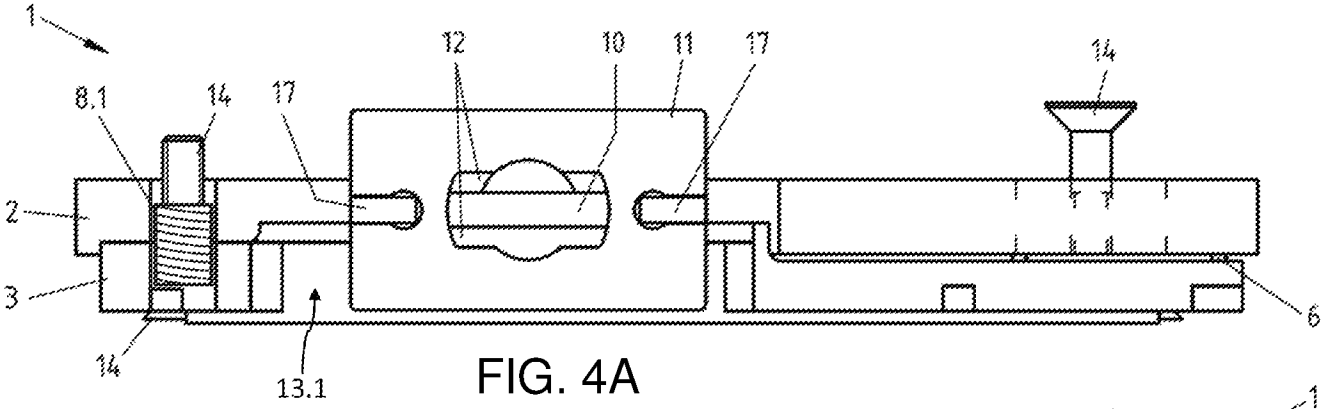
Figure 4B:
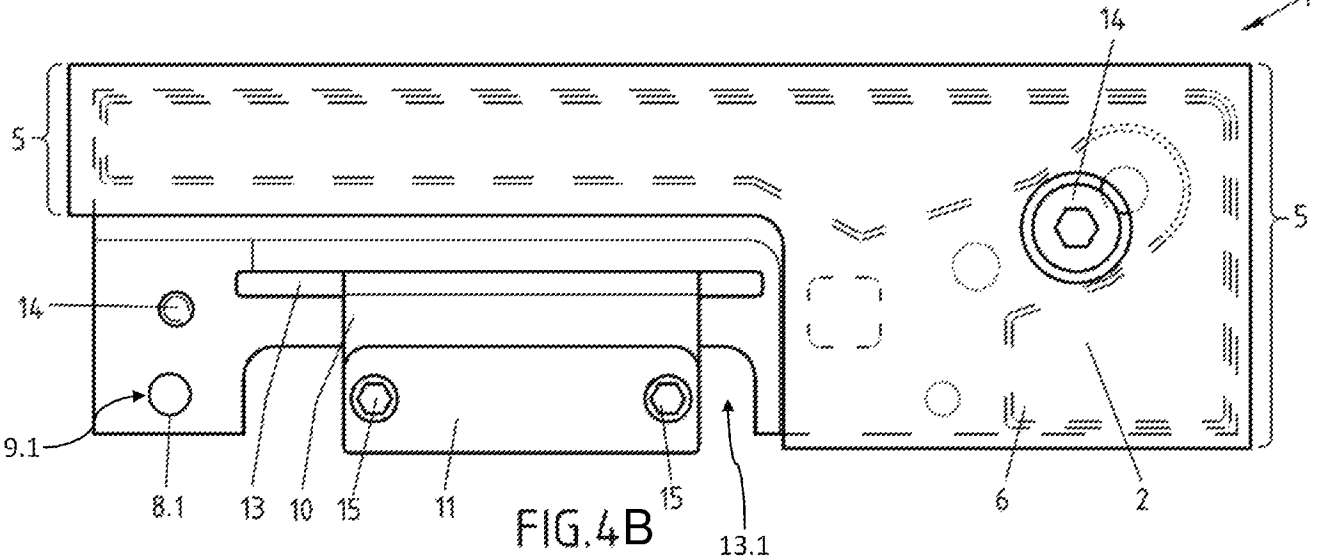

FIGS. 4 A and B likewise show the corner fitting 1 of FIGS. 2 and 3, wherein however here a door element 2 having an Italian glass cutout is restrained between the fitting elements 3 and 4. Presently, for the purpose of illustration, just the fitting element 3 is illustrated. In this case, a top view from the bottom is shown in FIG. 4 A, and a lateral view of the inventive corner fitting 1 is shown in FIG. 4 B. As can be seen in particular in Figure B, the Italian glass cutout superimposes the position for the second distancing element 8. Insofar, here just the distancing element 8.1, which is inserted into the aperture 9 of the fitting element 3, serves as a counter-bearing to the locating portion 5 and 5.1 and the door element 2 restrained between the fitting elements 3 and 4. As the extension of the variably adjustable distancing elements 8 and 8.1 is adaptable to the glass thickness of the door element 3, all door elements with an Italian glass cutout having different glass thicknesses can be restrained by the inventive corner fitting 1 and be disposed for example on an axis of rotation.

Figure 5B:
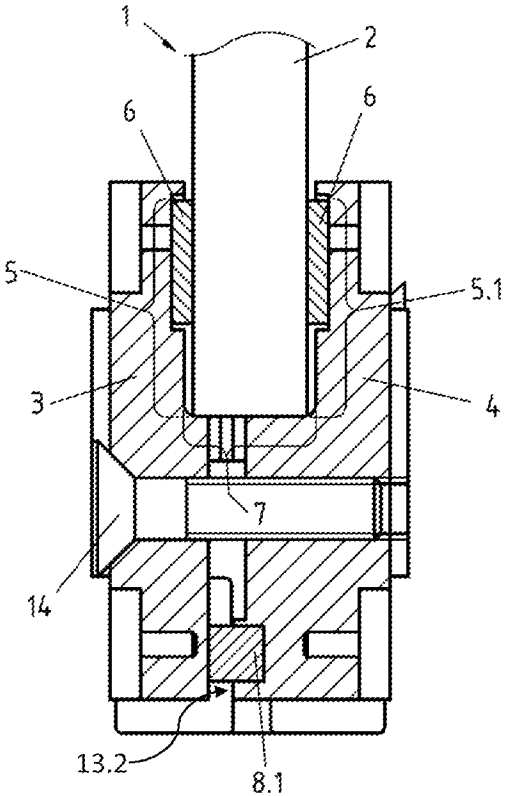
Figure 5A:
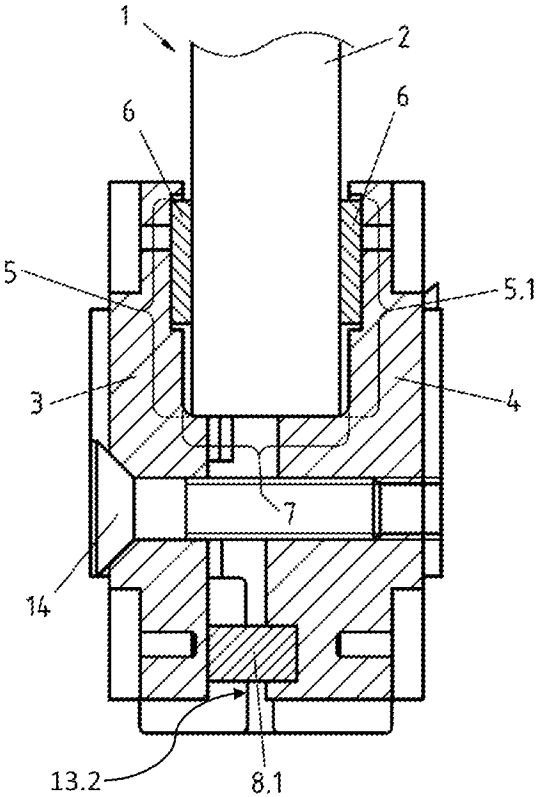

The advantageous functioning of the inventive corner fitting 1, namely in particular the consistent construction depth thereof with the same intermediate layers 6 is represented in an impressive way by illustrating the inventive corner fitting in a frontal sectional view in the FIGS. 5 A and B.

In FIG. 5 A, a door element 2 is clamped between the fitting elements 3 and 4, which compared to the door element 2 of FIG. 5 B has a glass thickness which is almost twice as thick. By way of example the door element 2 has a glass thickness of 15 mm in FIG. 5 A. By way of example the door element 2 in FIG. 5 B has a glass thickness of just 8 mm. As can be seen in both FIGS. 5 A and B, the distances between the fitting elements 3 and 4 and the door element 2, namely seen towards the surfaces thereof, are identical, because the intermediate layers 6 remain the same, namely when comparing the FIGS. 5 A and 5 B, they have the same material thickness, even though the glass thickness of the restrained door element is almost half as thick. Thus, independently of the glass thickness of the accommodated door element 2 and independently of the size of the restraining area 7, the construction depth of the inventive corner fitting 1 can remain constant. As pressure is built-up in the upper area of the corner fitting 1, namely between the fitting elements 3 and 4 on both sides of the door element 2 by tightening the attaching means 14, wherein the force applied for the pressure approximately in the center of the leaf thickness of the door element 2, i.e. almost in the center of the restraining area 7 in the resultant, is equal to zero, in the lower area of the corner fitting 1, namely between the fitting elements 3 and 4 outside the restraining area 7, a similar ratio of forces needs to be generated between the fitting elements 3 and 4. This is realized according to the disclosure by disposing the distancing element 8.1, which extends between the fitting elements 3 and 4 outside the restraining area 7 in the free space formed between the fitting elements 3 and 4 in the bottom area 13.2 between the fitting elements 3 and 4 and props up against the fitting elements 3 and 4. The size of the free space in the bottom area 13.2 between the fitting elements 3 and 4 in FIG. 5 B is so small that the fitting elements 3 and 4 almost contact each other. In contrast thereto, the free space in the bottom area 13.2 between the fitting elements 3 and 4 as illustrated in FIG. 5 A, is considerably larger. In this case, the adjustable length of the distancing element 8.1 in its extension direction is determined by the glass thickness of the door element 2. It can be seen that in FIG. 5 A, the length of the extension of the distancing element 8.1 between the fitting elements 3 and 4 is larger than the length of the extension of the distancing element 8.1 between the fitting elements 3 and 4 in FIG. 5 B, wherein however the overall length of the distancing element remains the same. In this case, the difference of the glass thickness of FIG. 5 A to the glass thickness of FIG. 5 B determines the length difference of the extension between the distancing element 8.1 of FIG. 5 A and the distancing element 8.1 of FIG. 5 B, i.e. the adjustment of the length of the extension of the variably adjustable distancing element 8.1.

Figure 6:
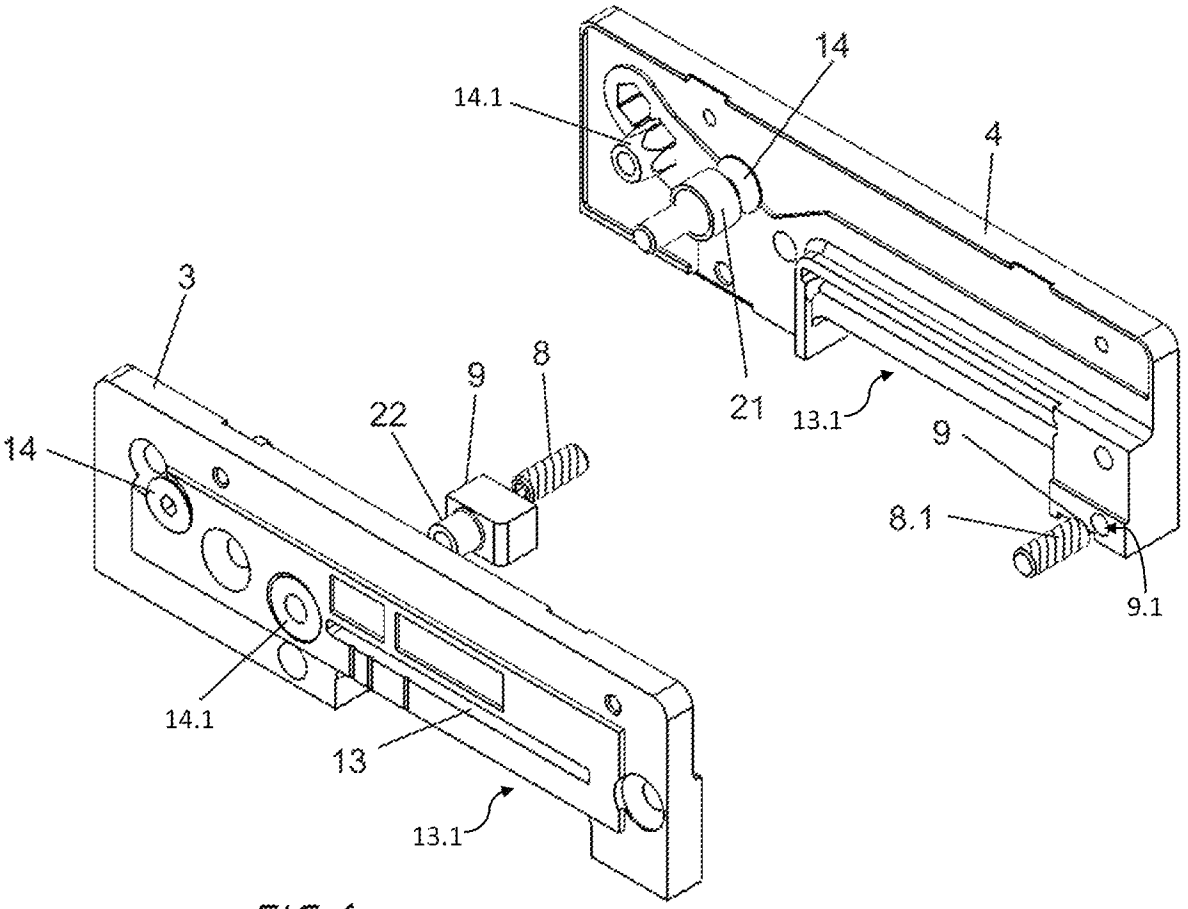
FIG. 6 shows an exploded drawing of an inventive door fitting, which is configured as a corner fitting, with the illustration reduced to attaching means and the distancing elements.

FIG. 6 shows an exploded view of an inventive corner fitting 1 wherein like in FIG. 2, a frame surrounding the fitting elements 3 and 4 and a cover element attached to the frame are not illustrated. Unlike the corner fitting illustrated in FIG. 2, for the sake of clarity, the illustration of the corner fitting shown in FIG. 6 is reduced to the attaching means 14 and the distancing elements 8 and 8.1 and the counter-holding means 20, respectively the mounts 9 thereof However, the reduced illustration should not interfere with the functioning of the inventive corner fitting 1. The corner fitting 1 illustrated in FIG. 6 rather fulfills all functions of the corner fitting 1 illustrated in FIG. 2.

Respectively one mount 9, which serves for disposing, i.e. for the screwing and unscrewing of the variably adjustable distancing elements 8 and 8.1, is provided in the lower area of the fitting elements 3 and 4. In the fitting element 4, the mount 9 for a reception 9.1 is provided in the shape of a bore with internal thread, which serves at least for the positive reception of the distancing elements 8.1. The mount 9 illustrated for the fitting element 3 for screwing and unscrewing the distancing element 8 is configured as a separate structural component, which engages, respectively can be inserted into for example a bore, in particular into a pocket hole configured at the fitting element 3. The mount 9 of the fitting element 3, just like the mount 9 of the fitting element 4 as well, includes a reception 9.1, which serves for screwing and unscrewing the distancing element 8. In the back part of the mount 9, the latter includes a sleeve-like extension 22, which serves for extending the bore, into which the distancing element 8 is screwable respectively unscrewable, by the length of the extension 22, and serves the purpose of screwing a distancing element 8 into the mount 9, which is lengthened by the length of the extension 22. As already illustrated in the FIGS. 3 and 4, depending on the type of the glass cutout of the door element 2, optionally the mount 9 inserted into the fitting element 3, respectively the distancing element 8 inserted at the fitting element 3 via the mount 9, can be optionally foregone, which, however, does not affect the functioning of the remaining distancing element, in this case the distancing element 8.1, nor does it affect the functioning of the corner fitting. As the screwable and unscrewable distancing elements 8 and 8.1 offer the possibility of extending the restraining area 7 to a maximum, usually longer attaching means 14 are required with increasing door leaf thickness, in particular with increasing glass thickness. However, for not having to include attaching means 14 of different lengths when shipping the inventive corner fitting 1, the attaching means 14 are non-positively and/or positively coupled respectively connected, which in the present case are embodied as riveting nuts, which pass through the fitting elements 3 and 4 and which, compared to simple nuts, include a longer thread, respectively a longer threaded portion, which extends between the two fitting elements 3 and 4. In addition, the thread or the threaded position of the counter-holding means 14.1 may be disposed at least slightly offset to the attaching means 14 such that the fitting elements 3 and 4 mutually brace, when screwing the attaching means 14 into the counter-holding means 14.1. This configuration and disposition of the counter-holding means 14.1 additionally allows for guaranteeing that sufficient thread, respectively internal thread is provided for being able to transfer the required tightening torques from the attaching means 14 guided in the counter-holding means 14.1. For preventing damage to the door element 2 in the area of the through-hole of the attaching means 14, respectively of the counter-holding means 14.1, a sleeve 21 can be pushed or screwed at least over the attaching means 14, which sleeve is positioned at least sectionwise over the threaded portion, i.e. the part or area of the counter-holding means 14.1, which contacts the door element 2 in the restraining area 7 in the through-hole. Particularly preferred, the sleeve 21 can be configured from a plastic material or a rubber elastic material. It is in particular preferred, if the sleeve 21 is cut from a PVC-tube.

Preferably, the counter-holding means 14.1 are configured from a polygon shank, preferred a hexagon shank, which engages in a polygon recess or preferred in a hexagon recess in the fitting elements 3 and 4, whereby the counter-holding means 14.1 are torque-proof disposed in the fitting elements 3 and 4. Thereby, when screwing in, respectively unscrewing from the attaching means 14 from the counter-holding means 14.1, the mounting of the attachment of the corner fitting 1 to the door element 2 can be simplified.

The invention claimed is:

1. A corner fitting for a door element, comprising a first fitting element and a second fitting element, wherein each of the fitting elements includes, at least sectionwise, a locating portion, which comprises an intermediate layer configured to contact the door element, and the fitting elements delimit a restraining area, wherein a holding element includes at least one connecting part and is interconnected to a connecting element and is movable in a recess disposed in the fitting elements such that the door element is aligned on a center of rotation and/or an axis, the connecting element includes a plurality of apertures configured for receiving the at least one connecting part, wherein at least one distancing element is disposed between the fitting elements and separate from the locating portions, wherein the distancing element forms a counter-bearing to the locating portions and to the door element, which can be restrained in the restraining area.

2. The corner fitting according to claim 1, wherein the distancing element has a variable adjustable length extending from at least one longitudinal axis of the fitting elements.

3. The corner fitting according to claim 1, wherein the distancing element includes a threaded means, by means of which a variable adjustable length extends from at least one longitudinal axis of the fitting elements.

4. The corner fitting according to claim 1, wherein the fitting elements include a mount separate from the locating portions and at which the distancing element is disposed.

5. The corner fitting according to claim 4, wherein the mount includes a reception, into which the distancing element extends.

6. The corner fitting according to claim 4, wherein the fitting elements are each embodied with a lower recess, in which the connecting element is displaceable, wherein a bottom area is configured as a free space between the fitting elements, and the distancing element is located at approximately the same height as that of the lower recess.

7. The corner fitting according to claim 4, wherein said at least one distancing element and a second distancing element, which extend almost parallel to each other and are separate from the locating portions and which form the counter-bearing to the locating portions and to the door element restrained in the restraining area.

8. The corner fitting according to claim 7, wherein each of the distancing elements, at least via one of their ends, is positively detachably connected in the mount, which is configured at the fitting element.

9. The corner fitting according to claim 4, wherein the mount includes a bore with an internal thread adapted to an external thread of the distancing element and in which the distancing element is screwable and/or from which it is unscrewable.

10. The corner fitting according to claim 1, wherein an attaching mechanism is incorporated at least at the holding element as well as at least at the connecting element, which mechanism is transferable between a released condition and a fixing condition, wherein, in the released condition, the holding element is displaceable at the fitting elements, and in the fixing condition it is fixedly attached to at least one fitting element.

11. The corner fitting according to claim 1, wherein the recess extends along the longitudinal extension at least of one fitting element, and the holding element is supported to be movable with a head part in the recess, wherein, in the fixing condition, the holding element with a resting portion, which as an engagement portion is located at the head part, abuts against the recess.

12. The corner fitting according to claim 10, wherein the attaching mechanism is configured such that during the transfer from the fixing condition into the released condition and from the released condition into the fixing condition, the holding element performs a stroke movement within a free space between the fitting elements.

13. The corner fitting according to claim 11, wherein the connecting element is attached via the attaching mechanism, wherein the head part and the connecting part are aligned vertically to each other.

14. A method for adjusting a corner fitting for a door element, for accommodating different material thicknesses of the door element in the corner fitting, including a first fitting element and a second fitting element, which, each at least sectionwise, include a locating portion, which comprises an intermediate layer able to contact the door element, and the fitting elements delimit the restraining area, wherein a holding element having at least one connecting part is interconnected to a connecting element and is movable in a recess disposed in the fitting elements such that the door element is aligned on a center of rotation and/or an axis, the connecting element having a plurality of apertures configured for receiving the at least one connecting part, at least one distancing element being disposed between the fitting elements and separate from the locating portions, wherein the distancing element forms a counter-bearing to the locating portions and to the door element, which can be restrained in the restraining area, including the following steps:

1) dismounting the fitting elements,
2) adjusting the length of the distancing element extending from at least one of the fitting elements, and
3) mounting the fitting elements.

* * * * *